US012760613B2

(12) United States Patent
Chamarthy et al.

(10) Patent No.: US 12,760,613 B2
(45) Date of Patent: Oct. 13, 2026

(54) DOWNHOLE DEBRIS COLLECTION DEVICE FOR HORIZONTAL WELLS

(71) Applicant: Halliburton Energy Services, Inc., Houston, TX (US)

(72) Inventors: Pramod Chamarthy, Carrollton, TX (US); Monserrath Solis, Jr., Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/886,797

(22) Filed: Sep. 16, 2024

(65) Prior Publication Data

US 2026/0078648 A1 Mar. 19, 2026

(51) Int. Cl.
*E21B 31/08* (2006.01)
*E21B 43/34* (2006.01)

(52) U.S. Cl.
CPC ..... *E21B 31/08* (2020.05); *E21B 43/35* (2020.05)

(58) Field of Classification Search
CPC ..... E21B 31/08; E21B 43/35
See application file for complete search history.

(56) References Cited

U.S. PATENT DOCUMENTS

| | | | | |
|---|---|---|---|---|
| 8,056,622 | B2 | 11/2011 | Lynde | |
| 8,109,331 | B2 | 2/2012 | Lynde et al. | |
| 8,316,965 | B2 | 11/2012 | Hallundbaek et al. | |
| 9,284,818 | B2 | 3/2016 | Hallundbaek et al. | |
| 9,334,704 | B2 * | 5/2016 | Mineo | E21B 34/063 |
| 9,890,605 | B2 | 2/2018 | Juhlin et al. | |
| 10,030,485 | B2 | 7/2018 | Gourmelon | |
| 10,072,472 | B2 | 9/2018 | Jensen | |
| 2007/0272404 | A1 * | 11/2007 | Lynde | E21B 47/18 166/99 |
| 2010/0258297 | A1 * | 10/2010 | Lynde | E21B 37/00 166/105.1 |
| 2010/0263856 | A1 | 10/2010 | Lynde et al. | |
| 2011/0024119 | A1 | 2/2011 | Wolf et al. | |
| 2015/0000896 | A1 | 1/2015 | Soni et al. | |
| 2015/0240583 | A1 * | 8/2015 | Mineo | E21B 27/04 166/104 |
| 2021/0332657 | A1 | 10/2021 | Chamarthy et al. | |

FOREIGN PATENT DOCUMENTS

WO 2008058540 A1 5/2008

OTHER PUBLICATIONS

How Dyson Vacuum Cleaners Work, Available at https://www.espares.co.uk/advice/careandmaintenance/how-dyson-vacuum-cleaners-work, Accessed Sep. 16, 2024.

International Search Report and Written Opinion for International Patent Application No. PCT/US2024/048920 dated Jun. 9, 2025. PDF file. 7 pages.

* cited by examiner

*Primary Examiner* — James G Sayre
(74) *Attorney, Agent, or Firm* — Benjamin Ford; C. Tumey Law Group, PLLC

(57) ABSTRACT

A debris collection tool that includes a debris valve, and a swirl generator that includes a first opening disposed on an exterior of the debris collection tool, and a second opening disposed inside the debris collection tool, where the first opening and the second opening are disposed at opposite axial ends of the swirl generator.

20 Claims, 16 Drawing Sheets

DOWNHOLE DEBRIS COLLECTION DEVICE FOR HORIZONTAL WELLS

BACKGROUND

The oil and gas industry may use wellbores as fluid conduits to access subterranean deposits of various fluids and minerals which may include hydrocarbons. A drilling operation may be utilized to construct the fluid conduits which are capable of producing hydrocarbons disposed in subterranean formations. Wellbores may be constructed, in increments, as tapered sections, which sequentially extend into a subterranean formation.

The widest diameter sections may be located near the surface of the earth while the narrowest diameter sections may be disposed at the toe of the well. For example, starting at the surface of the earth, the borehole sections which make up a wellbore may include any combination of a conductor borehole, one or more surface boreholes, one or more intermediate boreholes, a pilot borehole, and/or a production borehole. The diameter of the foregoing wellbore sections may sequentially decrease in diameter from the conductor borehole to the production borehole.

BRIEF DESCRIPTION OF DRAWINGS

These drawings illustrate certain aspects of some examples of the present disclosure and should not be used to limit or define the disclosure.

DETAILED DESCRIPTION

Overview and Advantages

In general, this application discloses one or more embodiments of methods and systems for using a swirl generator in a debris collection tool to remove debris within tubing of a borehole.

Conventionally, debris collection tools use direct suction or bailing techniques to remove debris by pumping debris-contaminated liquid through filters to catch the debris. However, once debris is collected against filters, flow paths through the filters are obstructed, and the pressures required to continue pumping liquid exceed allowable limits. Accordingly, such conventional devices allow for only a limited volume of debris to be removed in a single instance, as the filters quickly clog and limit the flow of the liquid. After gathering a small volume of debris, the debris collection tool must be pulled back to the surface where the debris can be emptied (e.g., the filters are cleaned). After emptying, the debris collection tool must be re-run downhole to collect additional and remaining debris. As multiple trips in-and-out of the tubing are required to remove all of the debris, significant amounts of time, money, and energy are expended performing this debris removal operation repeatedly.

As disclosed in one or more embodiments herein, a debris collection tool may include a swirl generator which causes fluid and debris to experience centrifugal forces. In turn, the centrifugal forces cause the liquid and debris to separate, where debris may be collected in designated volumes within the debris collection tool. As there is efficient separation of debris and liquid, greater volumes of debris may be removed in a single use of the debris collection tool. Further, as filters disposed in the debris collection tool do not clog (or do not clog as quickly), greater volumes of debris may be collected before removal is required. Accordingly, significant time and money are saved as fewer runs of a debris collection tool are required to remove unwanted debris in the tubing.

FIG. 1

Figure 1:
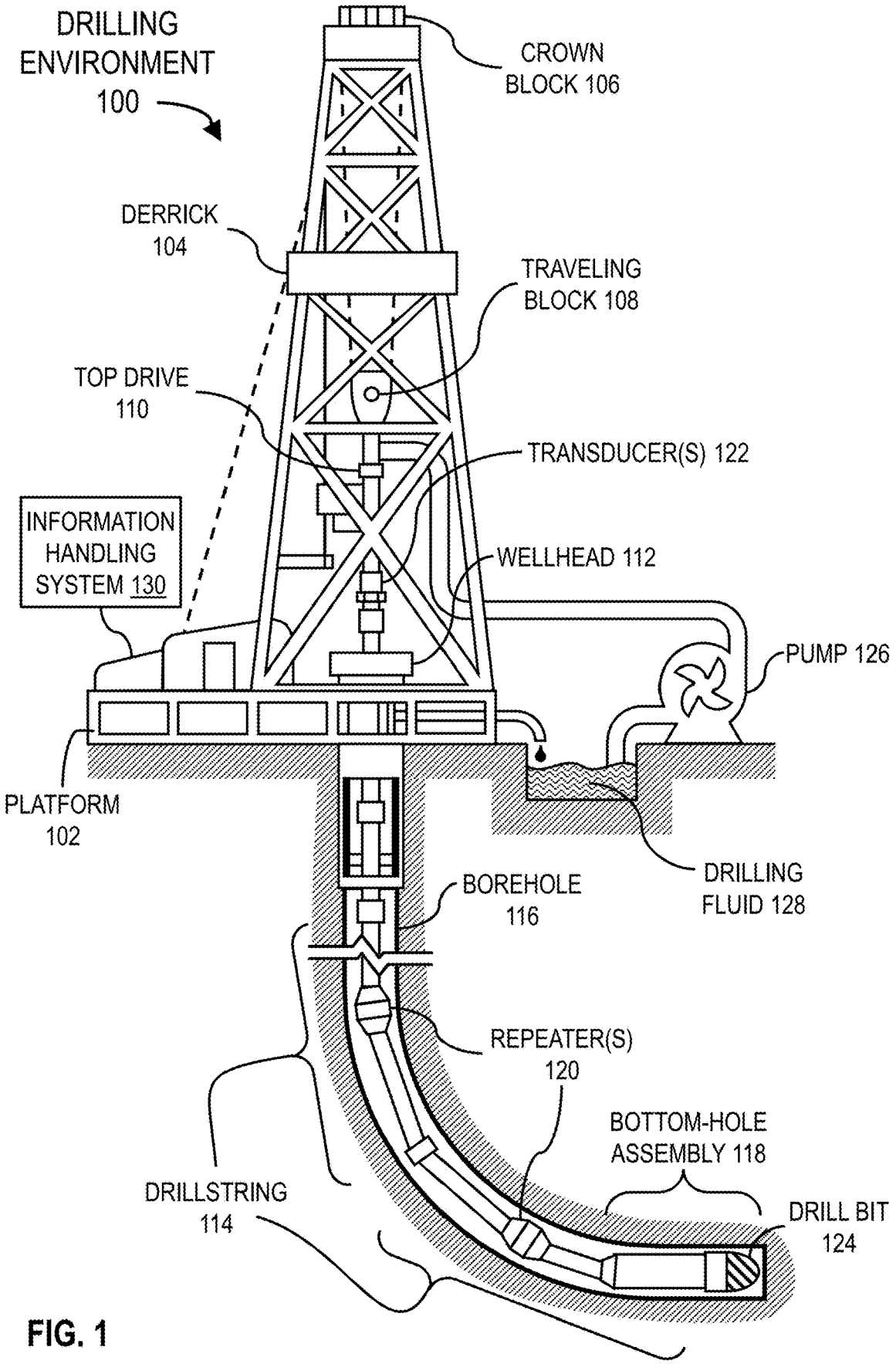
FIG. 1 is a diagram of an example drilling environment.

FIG. 1 is a diagram of an example drilling environment. Drilling environment 100 may include platform 102 that supports derrick 104 having a traveling block 108 for raising and lowering top drive 110 and drillstring 114. Top drive 110 supports and rotates drillstring 114 as it is lowered through wellhead 112. In turn, drill bit 124, located at the end of drillstring 114, may create borehole 116. Each of these components is described below.

Platform 102 is a structure which may be used to support one or more other components of drilling environment 100 (e.g., derrick 104). Platform 102 may be designed and constructed from suitable materials (e.g., concrete) which are able to withstand the forces applied by other components (e.g., the weight and counterforces experienced by derrick 104). In any embodiment, platform 102 may be constructed to provide a uniform surface for drilling operations in drilling environment 100.

Derrick 104 is a structure which may support, contain, and/or otherwise facilitate the operation of one or more pieces of the drilling equipment. In any embodiment, derrick 104 may provide support for crown block 106, traveling block 108, and/or any part connected to (and including) drillstring 114. Derrick 104 may be constructed from any suitable materials (e.g., steel) to provide the strength necessary to support those components.

Crown block 106 is one or more simple machine(s) which may be rigidly affixed to derrick 104 and include a set of pulleys (e.g., a "block"), threaded (e.g., "reeved") with a drilling line (e.g., a steel cable), to provide mechanical advantage. Crown block 106 may be disposed vertically above traveling block 108, where traveling block 108 is threaded with the same drilling line.

Traveling block 108 is one or more simple machine(s) which may be movably affixed to derrick 104 and include a set of pulleys, threaded with a drilling line, to provide mechanical advantage. Traveling block 108 may be disposed vertically below crown block 106, where crown block 106 is threaded with the same drilling line. In any embodiment, traveling block 108 may be mechanically coupled to drillstring 114 (e.g., via top drive 110) and allow for drillstring 114 (and/or any component thereof) to be lifted from (and out of) borehole 116. Both crown block 106 and traveling block 108 may use a series of parallel pulleys (e.g., in a "block and tackle" arrangement) to achieve significant mechanical advantage, allowing for the drillstring to handle greater loads (compared to a configuration that uses non-parallel tension). Traveling block 108 may move vertically (e.g., up, down) within derrick 104 via the extension and retraction of the drilling line.

Top drive 110 is a machine which may be configured to rotate drillstring 114. Top drive 110 may be affixed to traveling block 108 and configured to move vertically within derrick 104 (e.g., along with traveling block 108). In any embodiment, the rotation of drillstring 114 (caused by top drive 110) may allow for drillstring 114 to carve borehole 116. Top drive 110 may use one or more motor(s) and gearing mechanism(s) to cause rotations of drillstring 114. In any embodiment, a rotatory table (not shown) and a "Kelly" drive (not shown) may be used in addition to, or instead of, top drive 110.

Wellhead 112 is a machine which may include one or more pipes, caps, and/or valves to provide pressure control for contents within borehole 116 (e.g., when fluidly connected to a well (not shown)). In any embodiment, during drilling, wellhead 112 may be equipped with a blowout preventer (not shown) to prevent the flow of higher-pressure fluids (in borehole 116) from escaping to the surface in an uncontrolled manner. Wellhead 112 may be equipped with other ports and/or sensors to monitor pressures within borehole 116 and/or otherwise facilitate drilling operations.

Drillstring 114 is a machine which may be used to carve borehole 116 and/or gather data from borehole 116 and the surrounding geology. Drillstring 114 may include one or more drillpipe(s), one or more repeater(s) 120, and bottom-hole assembly 118. Drillstring 114 may rotate (e.g., via top drive 110) to form and deepen borehole 116 (e.g., via drill bit 124) and/or via one or more motor(s) attached to drillstring 114.

Borehole 116 is a hole in the ground which may be formed by drillstring 114 (and one or more components thereof). Borehole 116 may be partially or fully lined with casing to protect the surrounding ground from the contents of borehole 116, and conversely, to protect borehole 116 from the surrounding ground.

Bottom-hole assembly 118 is a machine which may be equipped with one or more tools for creating, providing structure, and maintaining borehole 116, as well as one or more tools for measuring the surrounding environment (e.g., measurement while drilling (MWD), logging while drilling (LWD)). In any embodiment, bottom-hole assembly 118 may be disposed at (or near) the end of drillstring 114 (e.g., in the most "downhole" portion of borehole 116).

Non-limiting examples of tools that may be included in bottom-hole assembly 118 include a drill bit (e.g., drill bit 124), casing tools (e.g., a shifting tool), a plugging tool, a mud motor, a drill collar (thick-walled steel pipes that provide weight and rigidity to aid the drilling process), actuators (and pistons attached thereto), a steering system, and any measurement tool (e.g., sensors, probes, particle generators, etc.).

Further, bottom-hole assembly 118 may include a telemetry sub to maintain a communications link with the surface (e.g., with information handling system 130). Such telemetry communications may be used for (i) transferring tool measurement data from bottom-hole assembly 118 to surface receivers, and/or (ii) receiving commands (from the surface) to bottom-hole assembly 118 (e.g., for use of one or more tool(s) in bottom-hole assembly 118).

Non-limiting examples of techniques for transferring tool measurement data (to the surface) include mud pulse telemetry and through-wall acoustic signaling. For through-wall acoustic signaling, one or more repeater(s) 120 may detect, amplify, and re-transmit signals from bottom-hole assembly 118 to the surface (e.g., to information handling system 130), and conversely, from the surface (e.g., from information handling system 130) to bottom-hole assembly 118.

Repeater 120 is a device which may be used to receive and send signals from one component of drilling environment 100 to another component of drilling environment 100. As a non-limiting example, repeater 120 may be used to receive a signal from a tool on bottom-hole assembly 118 and send that signal to information handling system 130. Two or more repeaters 120 may be used together, in series, such that a signal to/from bottom-hole assembly 118 may be relayed through two or more repeaters 120 before reaching its destination.

Transducer 122 is a device which may be configured to convert non-digital data (e.g., vibrations, other analog data) into a digital form suitable for information handling system 130. As a non-limiting example, one or more transducer(s) 122 may convert signals between mechanical and electrical forms, enabling information handling system 130 to receive the signals from a telemetry sub, on bottom-hole assembly 118, and conversely, transmit a downlink signal to the telemetry sub on bottom-hole assembly 118. In any embodiment, transducer 122 may be located at the surface and/or any part of drillstring 114 (e.g., as part of bottom-hole assembly 118).

Drill bit 124 is a machine which may be used to cut through, scrape, and/or crush (i.e., break apart) materials in the ground (e.g., rocks, dirt, clay, etc.). Drill bit 124 may be disposed at the frontmost point of drillstring 114 and bottom-hole assembly 118. In any embodiment, drill bit 124 may include one or more cutting edges (e.g., hardened metal points, surfaces, blades, protrusions, etc.) to form a geometry which aids in breaking ground materials loose and further crushing that material into smaller sizes. In any embodiment, drill bit 124 may be rotated and forced into (i.e., pushed against) the ground material to cause the cutting, scraping, and crushing action. The rotations of drill bit 124 may be caused by top drive 110 and/or one or more motor(s) located on drillstring 114 (e.g., on bottom-hole assembly 118).

Pump 126 is a machine that may be used to circulate drilling fluid 128 from a reservoir, through a feed pipe, to derrick 104, to the interior of drillstring 114, out through drill bit 124 (through orifices, not shown), back upward through borehole 116 (around drillstring 114), and back into the reservoir. In any embodiment, any appropriate pump 126 may be used (e.g., centrifugal, gear, etc.) which is powered by any suitable means (e.g., electricity, combustible fuel, etc.).

Drilling fluid 128 is a liquid which may be pumped through drillstring 114 and borehole 116 to collect drill cuttings, debris, and/or other ground material from the end of borehole 116 (e.g., the volume most recently hollowed by drill bit 124). Further, drilling fluid 128 may provide conductive cooling to drill bit 124 (and/or bottom-hole assembly 118). In any embodiment, drilling fluid 128 may be circulated via pump 126 and filtered to remove unwanted debris.

Information handling system 130 is a hardware computing system which may be operatively connected to drillstring 114 (and/or other various components of the drilling environment). In any embodiment, information handling system 130 may utilize any suitable form of wired and/or wireless communication to send and/or receive data to and/or from other components of drilling environment 100. In any embodiment, information handling system 130 may receive a digital telemetry signal, demodulate the signal, display data (e.g., via a visual output device), and/or store the data. In any embodiment, information handling system 130 may send a signal (with data) to one or more components of drilling environment 100 (e.g., to control one or more tools on bottom-hole assembly 118).

In any embodiment, information handling system 130 may be utilized to perform various steps, methods, and techniques disclosed herein (e.g., via the execution of software). In any embodiment, information handling system 130 may include one or more processor(s), cache, memory, storage, and/or one or more peripheral device(s). Any two or more of these components may be operatively connected via a system bus that provides a means for transferring data between those components.

FIG. 2

Figure 2:
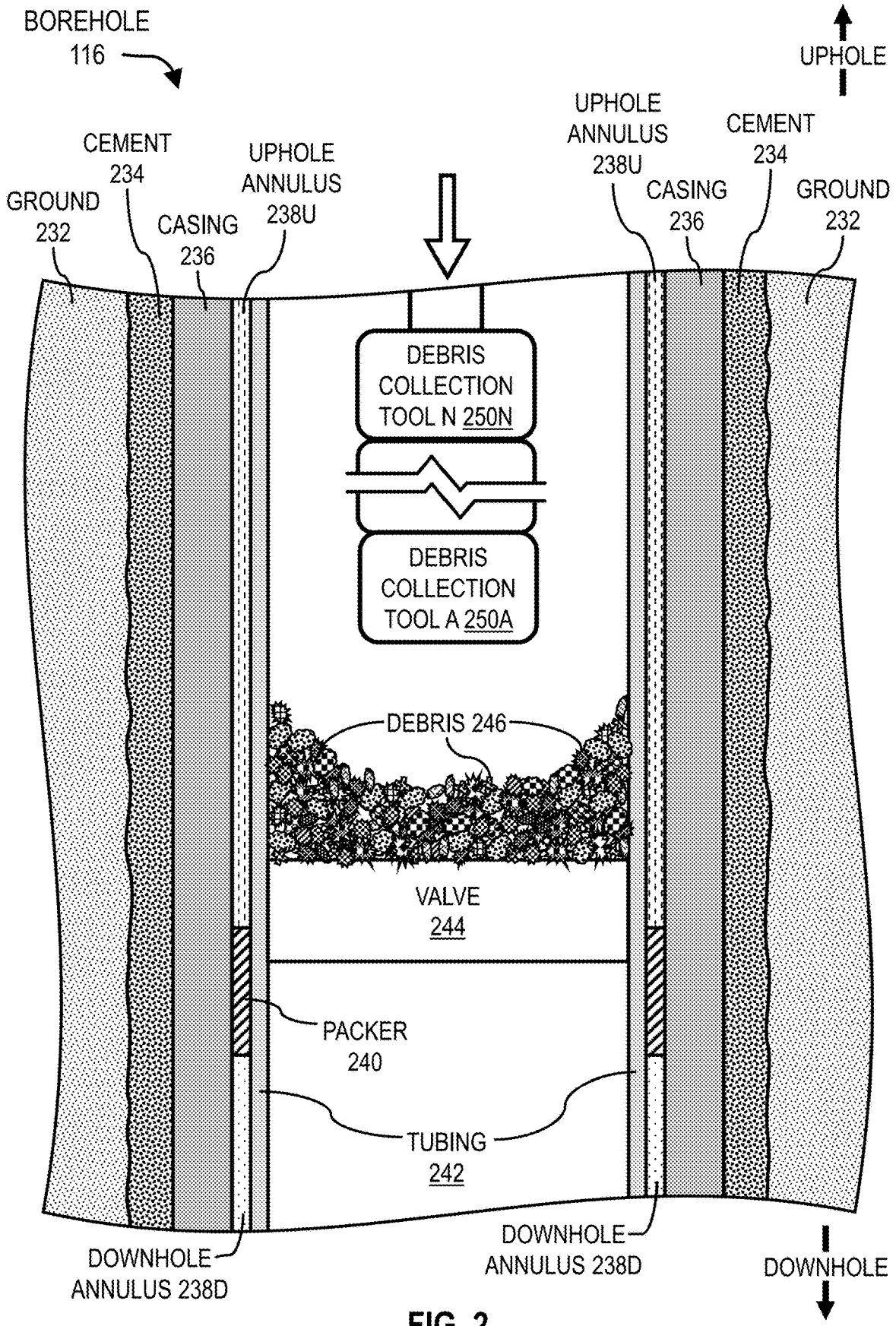
FIG. 2 is a diagram of an example borehole section with debris collection tools.

FIG. 2 is a diagram of an example borehole section with debris collection tools. Borehole 116 may include cement 234 to isolate ground 232 and hold casing 236 in position. In turn, tubing 242 may be installed in casing 236, where packer 240 surrounds a portion of tubing 242 separating uphole annulus 238U from downhole annulus 238D. Each of these components is described below.

Ground 232 is the surface and subsurface of Earth. In one or more embodiments, borehole 116 may be formed in ground 232 (e.g., using drill bit 124). Reservoirs (or other resource deposits) may be disposed in ground 232, which may be accessed via one or more borehole(s) 116.

Cement 234 is a binding material which may be used to set casing 236 in position in borehole 116. In one or more embodiments, borehole 116 may be created with uneven or pitted walls and/or with other cavities, voids, or dead ends. In such scenarios, cement 234 may act to fill those voids between ground 232 and casing 236 and thereby ensure solid support around casing 236.

Casing 236 is a structure which may be installed into borehole 116 and fixed in place via cement 234. In one or more embodiments, casing 236 is steel pipe which may be constructed in sections (e.g., 30 feet, 50 feet) and threaded into adjoining segments during installation.

Annulus 238, generally, is a void between casing 236 and tubing 242 which may be filled with a fluid (i.e., a liquid or gas). In one or more embodiments, the outer diameter of tubing 242 is constructed with a smaller diameter than the internal diameter of casing 236. Accordingly, tubing 242 may be inserted (and installed) into casing 236 with an open volume therebetween (i.e., annulus 238).

Uphole annulus 238U is a portion of annulus 238 (around tubing 242 and inside casing 236) that is separated from downhole annulus by packer 240. In one or more embodiments, uphole annulus 238U may be filled with a liquid or gas, which may be circulated from the surface (e.g., at wellhead 112).

Downhole annulus 238D is a portion of annulus 238 (around tubing 242 and inside casing 236) that is separated from uphole annulus 238U by packer 240. In one or more embodiments, downhole annulus 238D may be filled with a liquid or gas, and in fluid contact with a reservoir.

Packer 240 (i.e., "packing element") is a mechanical device which may be used to isolate annulus 238 into two sections (e.g., uphole annulus 238U and downhole annulus 238D). In one or more embodiments, by isolating downhole annulus 238D from uphole annulus 238U, the contents of a reservoir may be constrained to flow through only designated channels (e.g., tubing 242). Further, contents of uphole annulus 238U may be pumped, circulated, or otherwise exchanged without loss to a reservoir further downhole.

Tubing 242 is a structure which may be placed in borehole 116 and act as a conduit for fluids. In one or more embodiments, tubing 242 may be used for the extraction of resources from a reservoir (e.g., production tubing). To prevent the flow of fluids through borehole 116 outside of tubing 242, tubing 242 may be circumscribed by packer 240 (or another sealing device) which may then prevent the flow of fluids past packer 240 (i.e., into uphole annulus 238U). Valve 244 may be installed inside tubing 242 to control the flow of fluids through tubing 242.

Valve 244 is a mechanical device which may be used to open and close a conduit in which valve 244 is installed (e.g., tubing 242). Non-limiting examples of valve 244 include a ball valve, a butterfly valve, flapper valve, gate valve, globe valve, etc. In one or more embodiments, valve 244 may narrow the path through which fluid flows (even when fully open). Consequently, when open or closed, valve 244 may form a surface on which debris 246 may accumulate.

Debris 246 is matter in tubing 242 which may be undesirable. In one or more embodiments, debris 246 may cause components (e.g., valve) and/or tools (any tool that may be disposed in tubing 242) to malfunction, as debris 246 may clog openings and/or prevent moving parts (of those devices) from actuating properly. Further, debris 246 may cause corrosion and/or unnecessary wear on tubing 242. Non-limiting examples of debris include metal particles (shavings, burrs, etc.), rocks, stones, sand, coagulated greases and oils, and/or any other unwanted matter which may collect in tubing 242.

Debris collection tool 250 is a device which may be used to gather, collect, and/or otherwise capture debris 246 and store that debris 246 for removal from tubing 242. Additional details regarding debris collection tool 250 may be found in the description of FIG. 3 and FIG. 5A. In one or more embodiments, as shown in FIG. 2, two or more debris collection tool 250 may be attached, in line, such that the output of one debris collection tool 250 (e.g., debris collection tool A 250A) feeds into the next debris collection tool 250 (not labeled) until reaching a final debris collection tool 250 in the line (e.g., debris collection tool N 250N). Multiple debris collection tools 250, attached in series, may be used to capture different sizes of debris. As a non-limiting example, a leading debris collection tool 250 (e.g., debris collection tool A 250A, disposed most downhole) may be used to capture debris 246 with the largest sizes (e.g., average diameter of 0.1 to 0.05 inches) and allowing debris 246 smaller than 0.05 to pass through to a second debris collection tool 250. Next, the second debris collection tool 250 may be used to capture debris 246 with the medium sizes (e.g., average diameter of 0.05 to 0.01 inches) and allowing debris 246 smaller than 0.01 to pass through. In turn, a third, fourth, etc. debris collection tool 250 may be used to capture smaller and smaller particles of debris 246.

FIG. 3

Figure 3:
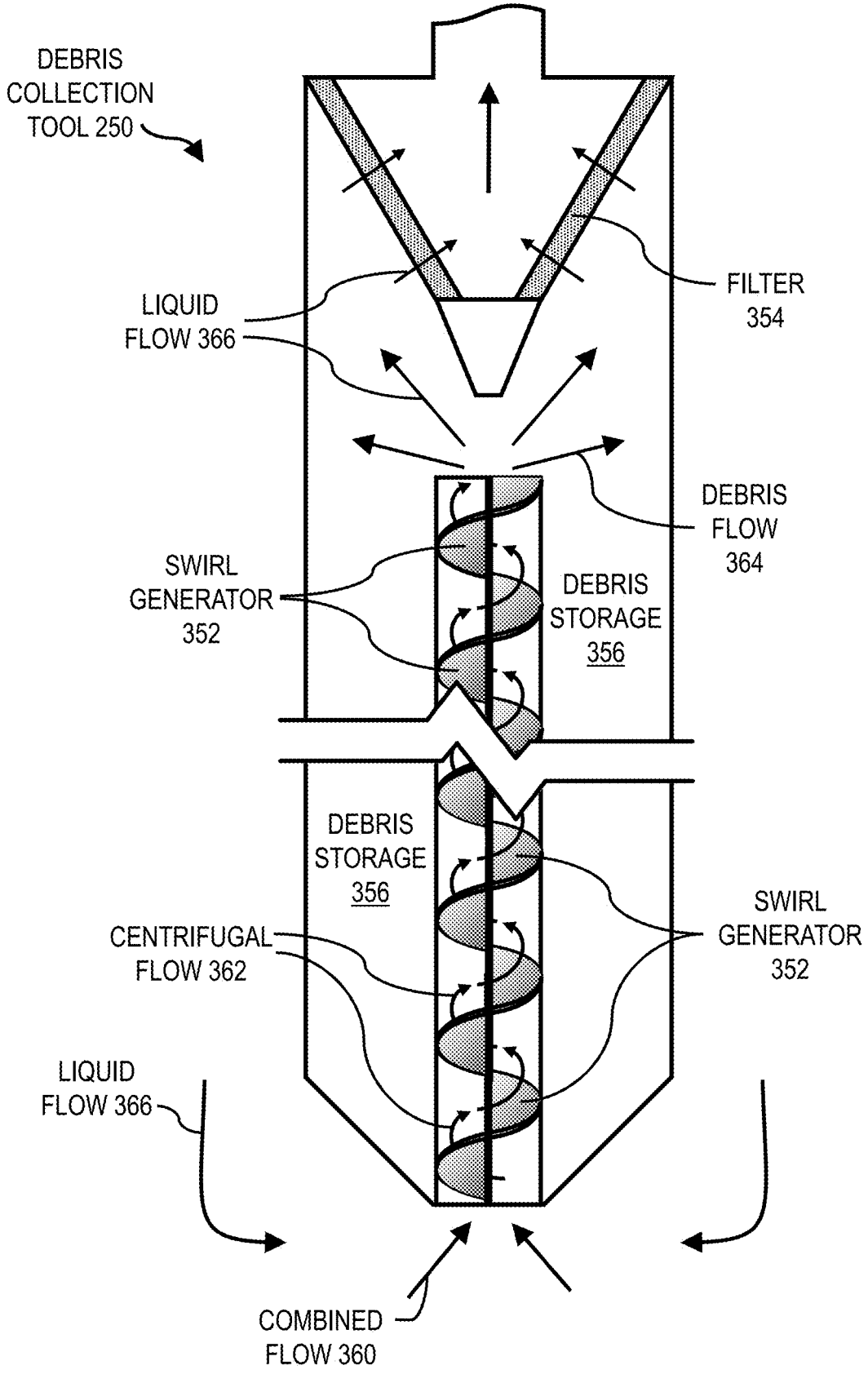
FIG. 3 is a diagram of an example embodiment of a debris collection tool.

FIG. 3 is a diagram of an example embodiment of a debris collection tool.

Debris collection tool 250 is a device used to collect and store debris 246 from tubing 242. In one or more embodiments, debris collection tool 250 includes swirl generator 352, filter 354, and debris storage 356. Debris collection tool 250 may function by causing combined liquid and debris 246 (i.e., combined flow 360) to enter and separate into separate debris flow 364 and liquid flow 366 via centrifugal forces caused by swirl generator 352.

Swirl generator 352 is a component of debris collection tool 250 which may cause centrifugal flow 362 of liquids and debris 246 traversing therethrough. In one or more embodiments, the geometry of swirl generator 352 causes liquid and solids (e.g., debris 246) therein to undergo a "swirling" (e.g., circular, elliptical, cyclone) flow path while still maintaining an overall axial flow direction. In one or more embodiments, the opening (and exit) for swirl generator 352 is aligned with the axial path centered through centrifugal flow 362. That is, combined flow 360 (and/or liquid flow 366 and/or debris flow 364) enters into swirl generator 352 in a direction parallel to the overall flow through swirl generator 352 (and not at tangential and/or orthogonal entrance disposed on a side of swirl generator 352). Thus, in one or more embodiments, debris 246 may be collected at a lower distal end of debris collection tool 250 without redirecting flow. In one or more embodiments, swirl generator 352 may have two openings (e.g., a first opening and a second opening). A first opening of swirl generator 352 may be disposed at the most downhole distal end of debris collection tool 250 (where debris 246 enters as combined flow 360) disposed at opposite axial ends of swirl generator 352. A second opening of swirl generator 352 may be disposed internally within debris collection tool 250, where centrifugal flow 362 stops and separates into liquid flow 366 and debris flow 364.

Filter 354 is a component which is used to separate solid particles of matter (e.g., debris 246) from liquid. In one or more embodiments, filter 354 may function by including one or more holes across a surface which allow for particles of a certain size (or smaller) to pass through but prevent particles larger than that certain size from traversing filter 354. Non-limiting examples of filter 354 include sand screens and mesh filters.

Debris storage 356 is a volume inside debris collection tool 250 which may be used to store debris 246. In one or more embodiments, when debris collection tool 250 is oriented vertically (with filter 354 disposed above swirl generator 352) debris storage 356 may be disposed at the lower end of debris collection tool 250, where gravity will carry debris 246 into debris storage 356. In one or more embodiments, debris storage 356 may be along the outer walls of debris collection tool 250 (e.g., see FIG. 5A), where debris collection tool 250 may not have any particular orientation when disposed downhole.

Combined flow 360 is a combination of liquid flow and debris flow 364. Combined flow 360 may include liquid and debris 246 flowing together. In one or more embodiments, combined flow occurs when liquid flow 366 (flowing around debris collection tool 250) picks up debris 246 and causes debris 246 to move with liquid.

Centrifugal flow 362 is combined flow 360 experiencing centrifugal forces when flowing through swirl generator 352. As combined flow 360 is forced into swirl generator 352, the geometry of swirl generator 352 causes a swirling motion of combined flow 360 into centrifugal flow 362. In turn, the liquid and debris 246 in centrifugal flow 362 gain centrifugal momentum due to the circular (swirling) direction of the flow.

Debris flow 364 is the flow of debris 246, as distinguished from liquid flow 366. One of ordinary skill in the art, provided the benefit of this detailed description, would understand that liquid would still occupy the volume around debris 246, but the majority of liquid (in liquid flow 366) is along paths apart from debris flow 364 (as caused by the centrifugal forces of swirl generator 352). In one or more embodiments, debris flow 364 may only be distinguishable from liquid flow 366 after traversing swirl generator 352, where centrifugal forces cause debris 246 to exit swirl generator 352 in a different direction than a majority of the liquid flowing therethrough.

Liquid flow 366 is the flow of liquid, as distinguished from debris flow 364. Liquid flow may begin around debris collection tool 250 before picking up debris 246 (becoming combined flow 360). After traversing through swirl generator 352 (as centrifugal flow 362), liquid flow 366 exits with less outward momentum (than debris flow 364) and therefore separates from debris 246.

FIGS. 4A-4I

Figure 4A:
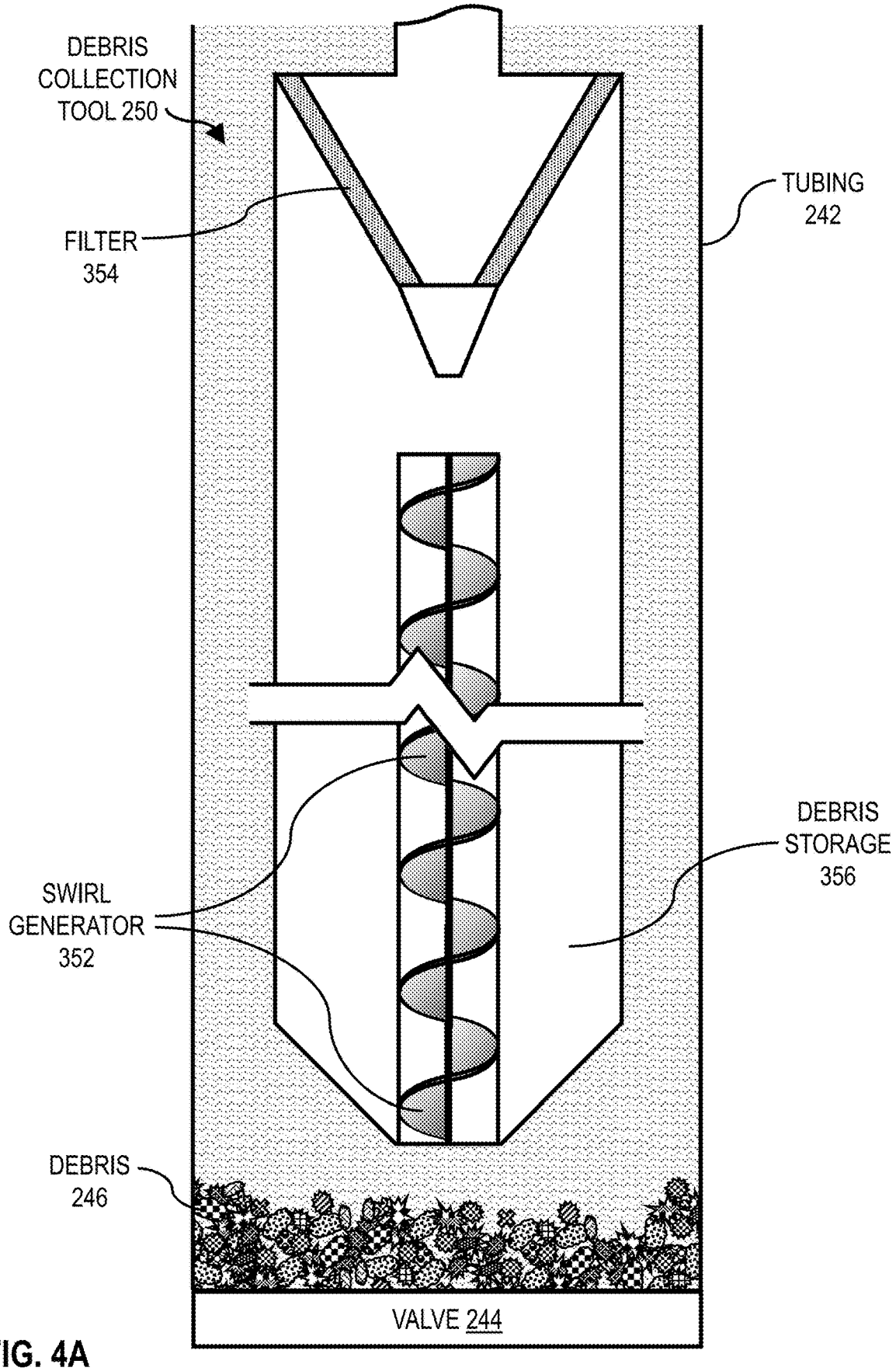
FIG. 4A is a diagram of an example debris collection tool after approaching debris on a valve.
Figure 4B:
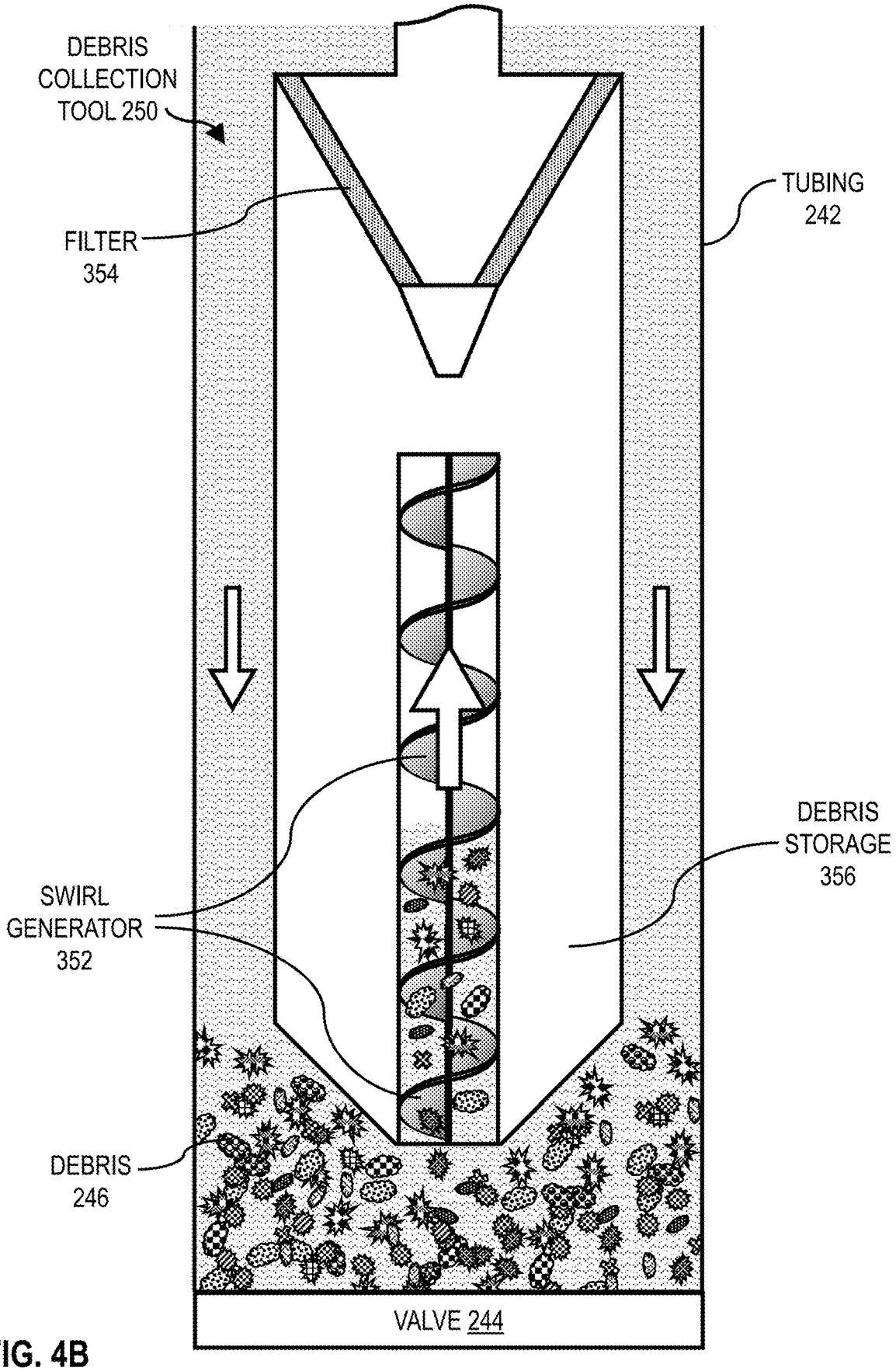
FIG. 4B is a diagram of an example debris collection initiating suction on debris.
Figure 4C:
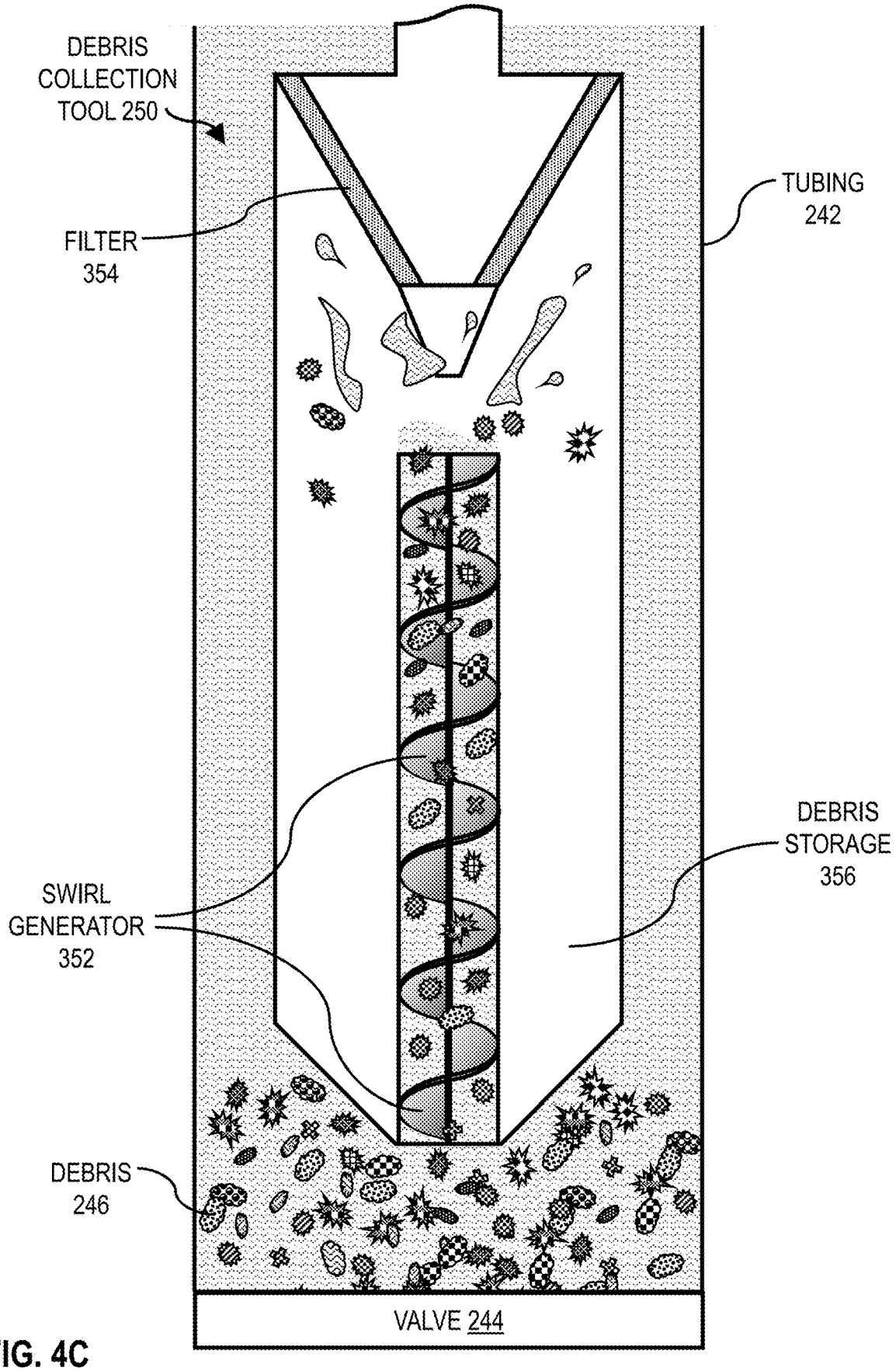
FIG. 4C is a diagram of an example debris collection sucking debris and liquid internally.
Figure 4D:
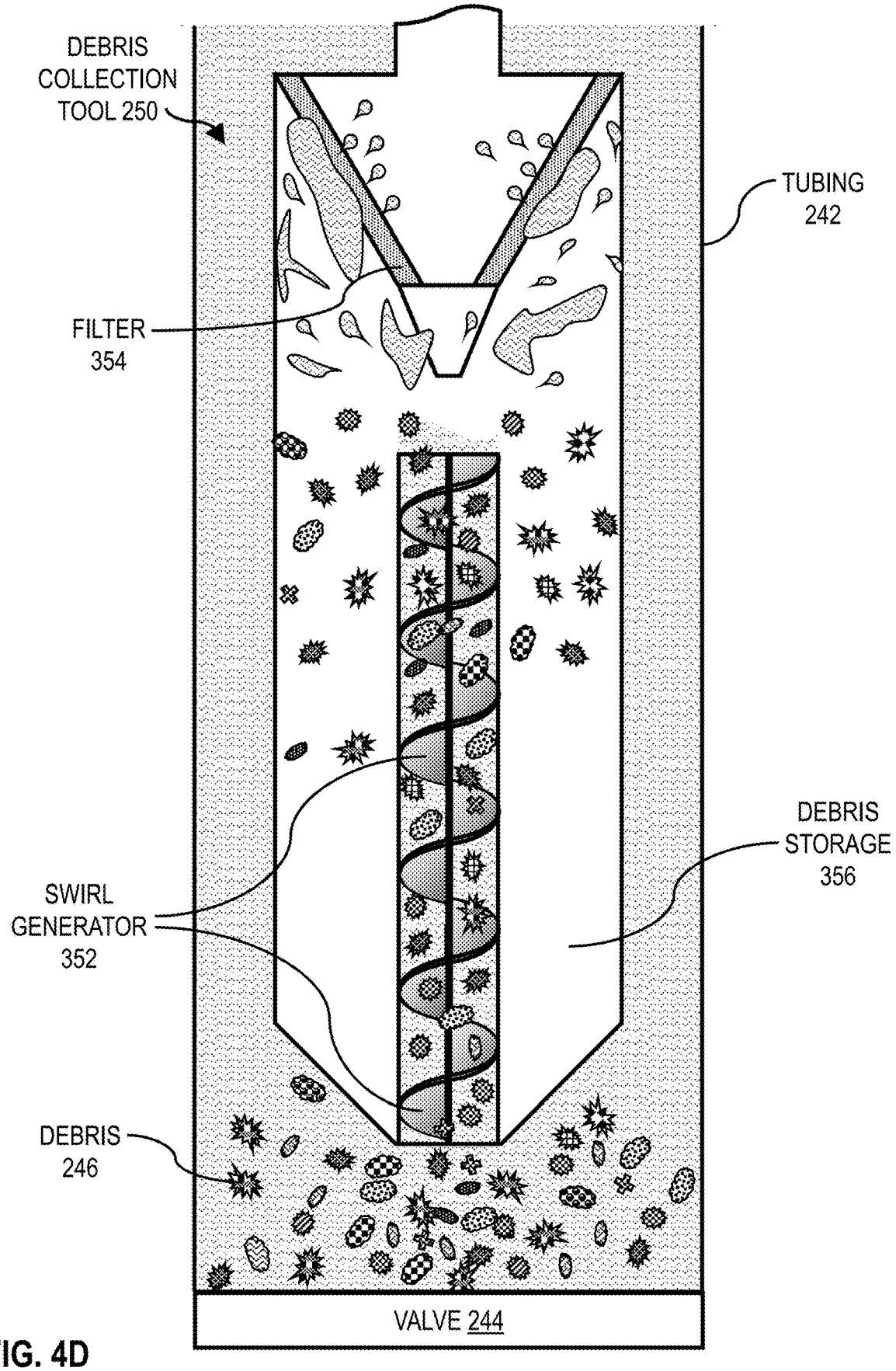
FIG. 4D is a diagram of an example debris collection sucking debris and liquid internally with debris falling to the sides.
Figure 4E:
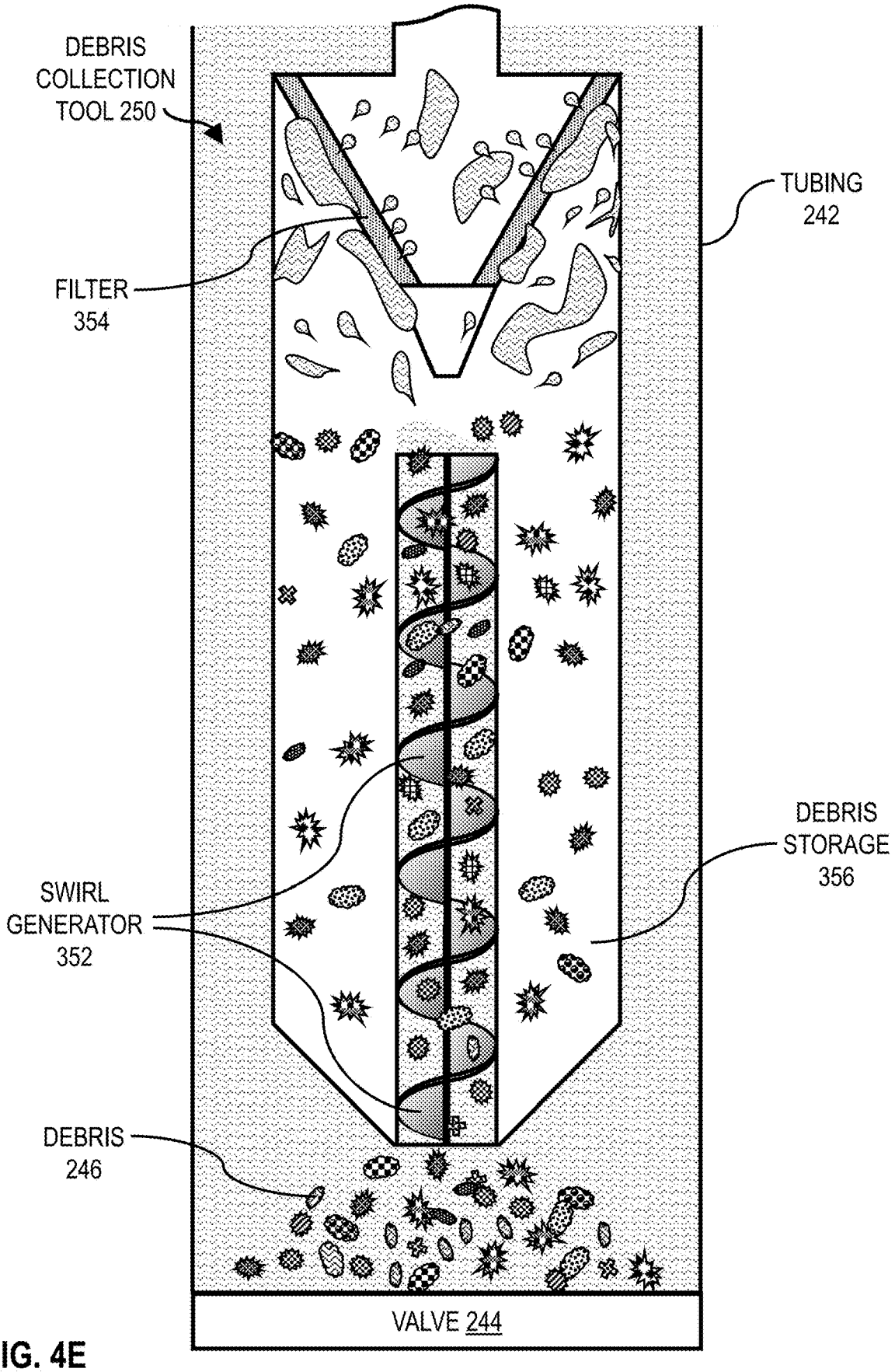
FIG. 4E is a diagram of an example debris collection sucking debris and liquid internally with debris falling to the sides and accumulating in debris storage.
Figure 4F:
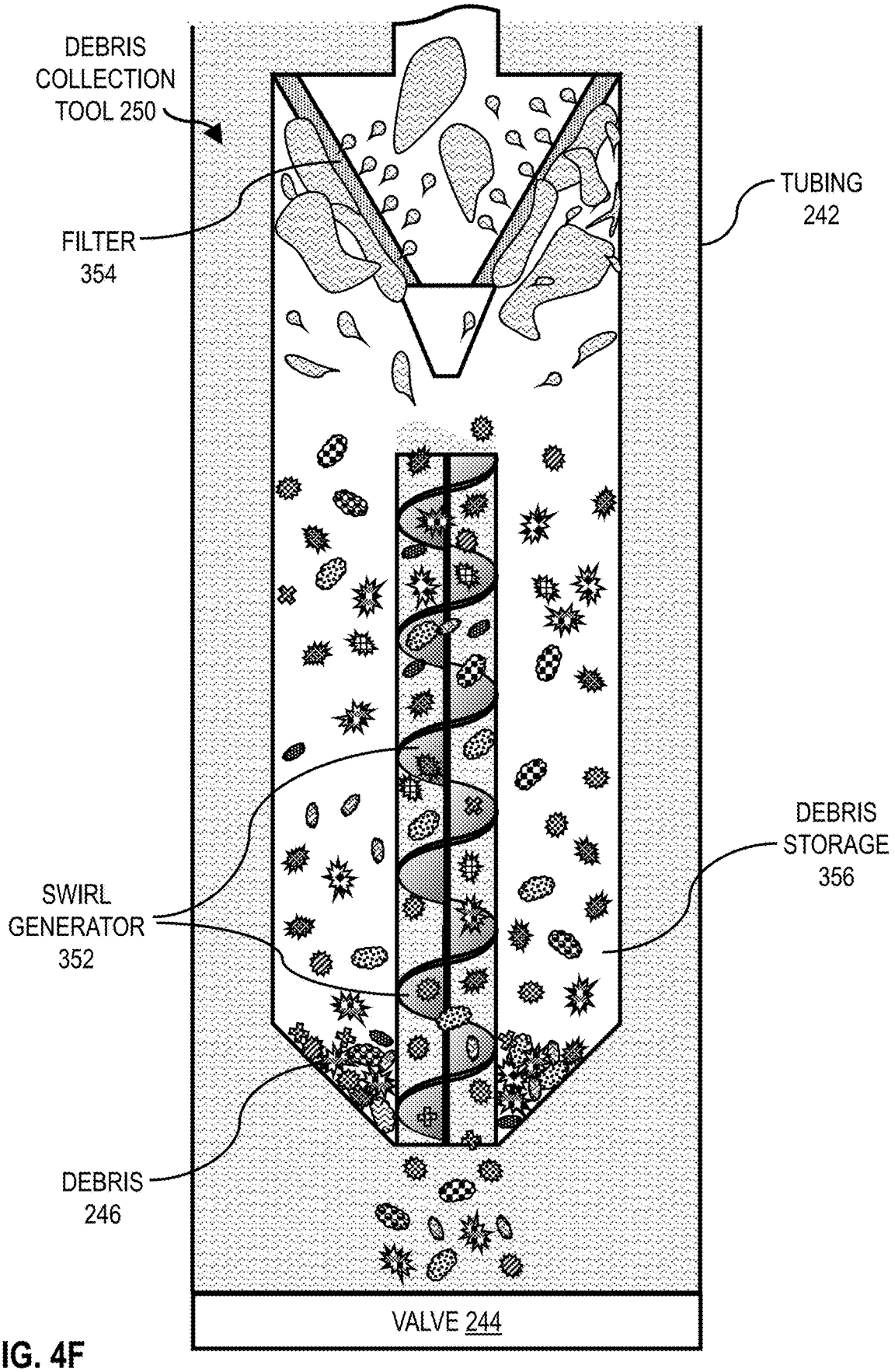
FIG. 4F is a diagram of an example debris collection sucking remaining debris from the tubing.
Figure 4G:
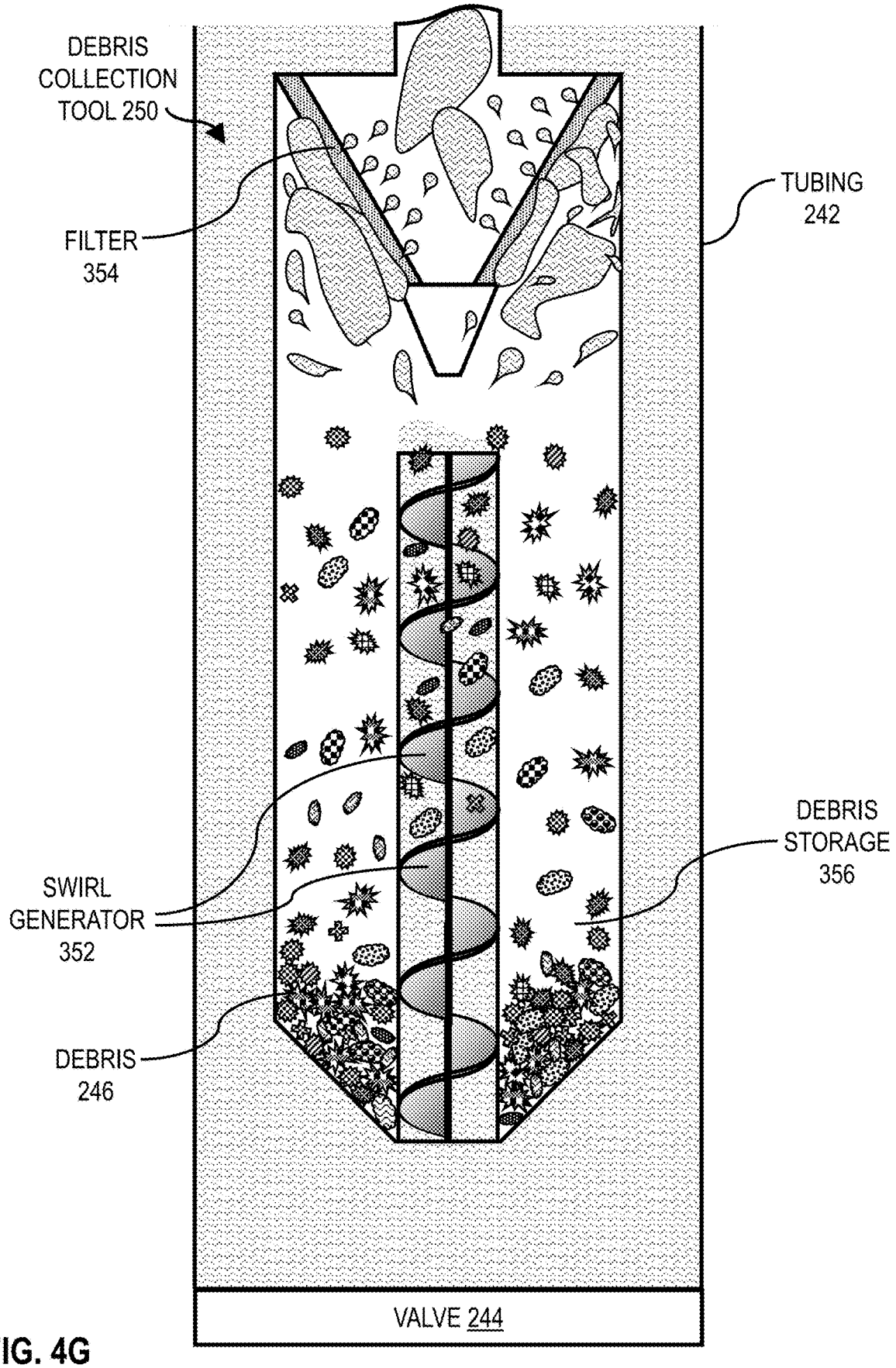
FIG. 4G is a diagram of an example debris collection when sucking remaining debris through a swirl generator.
Figure 4H:
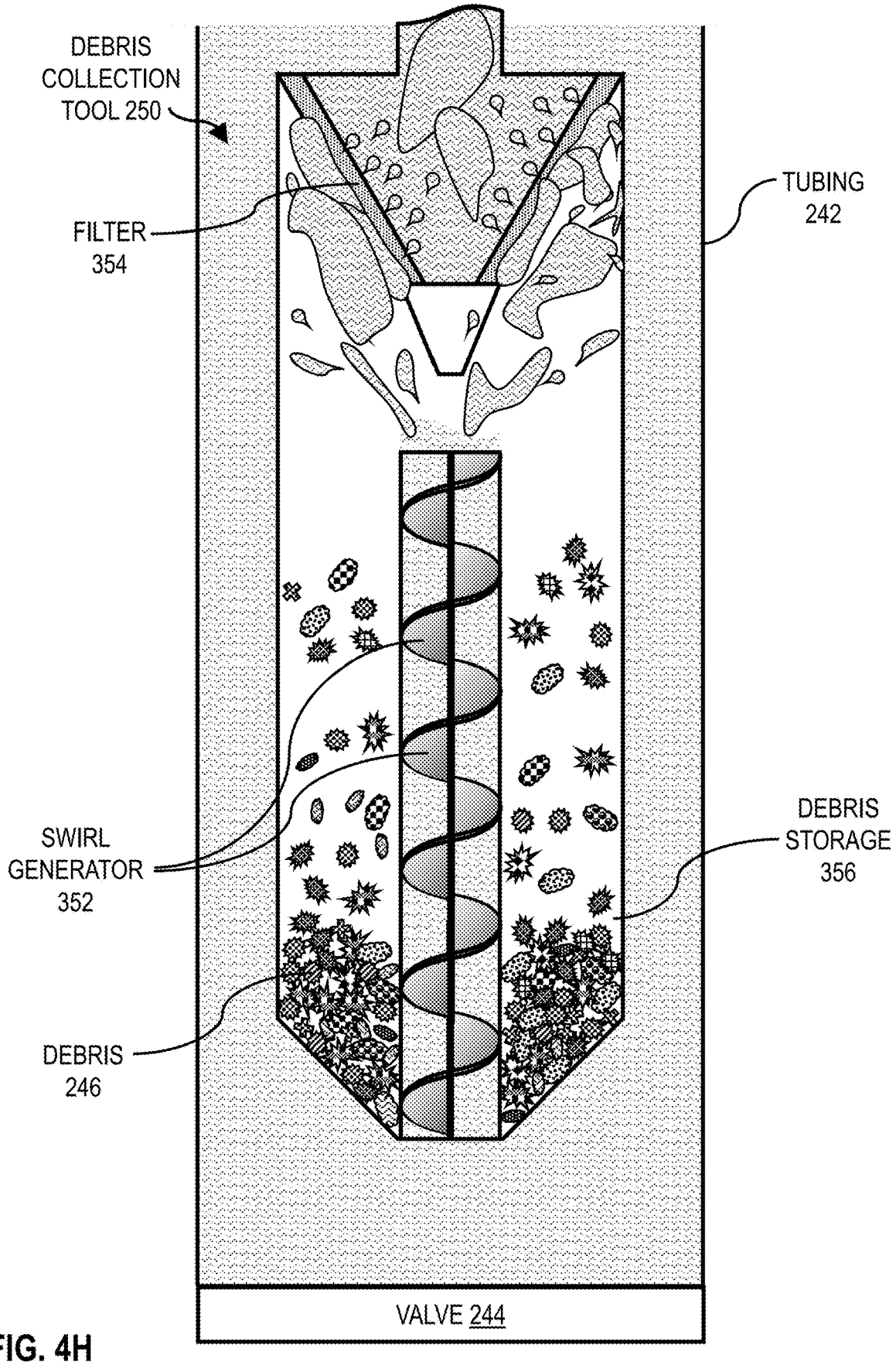
FIG. 4H is a diagram of an example debris collection after separating debris into debris storage.
Figure 4I:
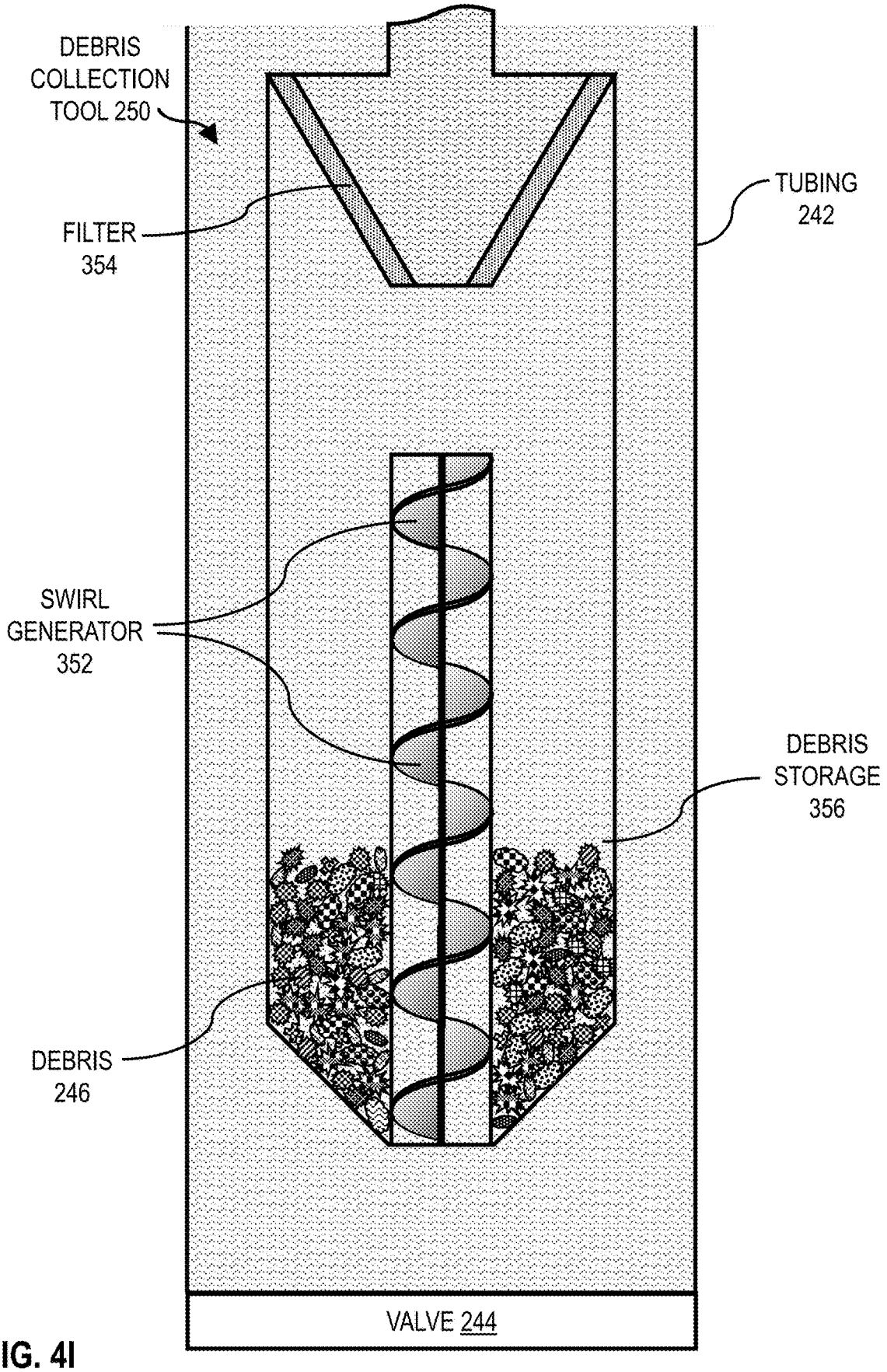
FIG. 4I is a diagram of an example debris collection sucking liquid after collecting debris in debris storage.

FIG. 4A is a diagram of an example debris collection tool after approaching debris on a valve. FIG. 4B is a diagram of an example debris collection initiating suction on debris. FIG. 4C is a diagram of an example debris collection sucking debris and liquid internally. FIG. 4D is a diagram of an example debris collection sucking debris and liquid internally with debris falling to the sides. FIG. 4E is a diagram of an example debris collection sucking debris and liquid internally with debris falling to the sides and accumulating in debris storage. FIG. 4F is a diagram of an example debris collection sucking remaining debris from the tubing. FIG. 4G is a diagram of an example debris collection when sucking remaining debris through a swirl generator. FIG. 4H is a diagram of an example debris collection after separating debris into debris storage. FIG. 4I is a diagram of an example debris collection sucking liquid after collecting debris in debris storage.

For the purposes of the example of FIGS. 4A-4I, debris collection tool 250 is oriented vertically, with filter 354 disposed vertically above valve 244. Further, to avoid cluttering the figures and to aid in the visualization of the flow within debris collection tool 250, liquid is shown as multiple droplets and masses. However, one of ordinary skill in the art, provided the benefit of this detailed description, would understand that any free volume in debris collection tool 250 would be filled with liquid (e.g., in debris storage 356, completely surrounding filter 354 and the entire upper end of debris collection tool 250.

In FIG. 4A, debris collection tool 250 is shown in a state after being placed downhole and approaching debris 246 deposited on valve 244. In FIG. 4A, suction for debris collection tool 250 has not yet been activated (e.g., causing downward flow in tubing 242 and upward flow through debris collection tool 250).

In FIG. 4B, debris collection tool 250 is shown shortly after suction has started through swirl generator 352. Debris 246 and liquid in tubing 242 begin to traverse swirl generator 352 and undergo centrifugal flow 362. In one or more embodiments, suction through debris collection tool 250 is caused by initiating flow (downward) in tubing 242 around debris collection tool 250 and/or by initiating flow (upward) through debris collection tool 250. As the opening for swirl generator 352 is disposed at the lowest distal end of debris collection tool 250, debris 246 in the vicinity of that opening may be sucked into swirl generator 352 by the initiated flow.

In FIG. 4C, debris 246 and liquid begin to expel out from swirl generator 352. As both liquid and debris 246 experience centrifugal forces, they are expelled towards the outer walls of debris collection tool 250, while still maintaining axial momentum. However, as debris 246 is of higher density (having more mass per volume) than liquid, debris 246 carries more outward momentum than the liquid.

In FIG. 4D, debris 246 and liquid continues to be sucked through debris collection tool 250 and separated via centrifugal forces. Further, liquid traverses through filter 354 to continue flowing upward through debris collection tool 250. Filter 354 may further prevent debris 246 (which may flow up against filter 354, not shown) from traversing through debris collection tool 250. Accordingly, smaller and/or less dense debris 246 (that is less effected by centrifugal forces) is caused to remain in the lower end of debris collection tool 250.

In FIG. 4E, debris 246 begins to fall down into debris storage 356, towards the lower end of debris collection tool 250. In one or more embodiments, as gravity acts on debris 246 and without sufficient flow momentum to move upward against filter 354, debris 246 falls to the lower cavities of (i.e., debris storage 356) where debris 246 remains until debris collection tool 250 is pulled uphole to the surface.

In FIG. 4F, like FIG. 4E, debris 246 continues to fall down into debris storage 356, towards the lower end of debris collection tool 250. Debris 246 accumulates in debris storage 356 as liquid and debris 246 continue to be separated. Liquid continues to flow upward through filter 354 and debris collection tool 250 generally.

In FIGS. 4G-4H, the remaining debris 246 is removed from the surface of valve 244 and brought within debris collection tool 250. Flow through debris collection tool 250 continues to separate debris 246 from liquid and deposit that debris 246 into debris storage 356.

In FIG. 4I, all debris 246 is settled into debris storage 356 of debris collection tool 250. Flow (i.e., liquid flow 366) through debris collection tool 250 is stopped and debris collection tool 250 is ready to be pulled uphole to the surface, where debris 246 removed from debris collection tool 250.

FIGS. 5A-5D

Figure 5A:
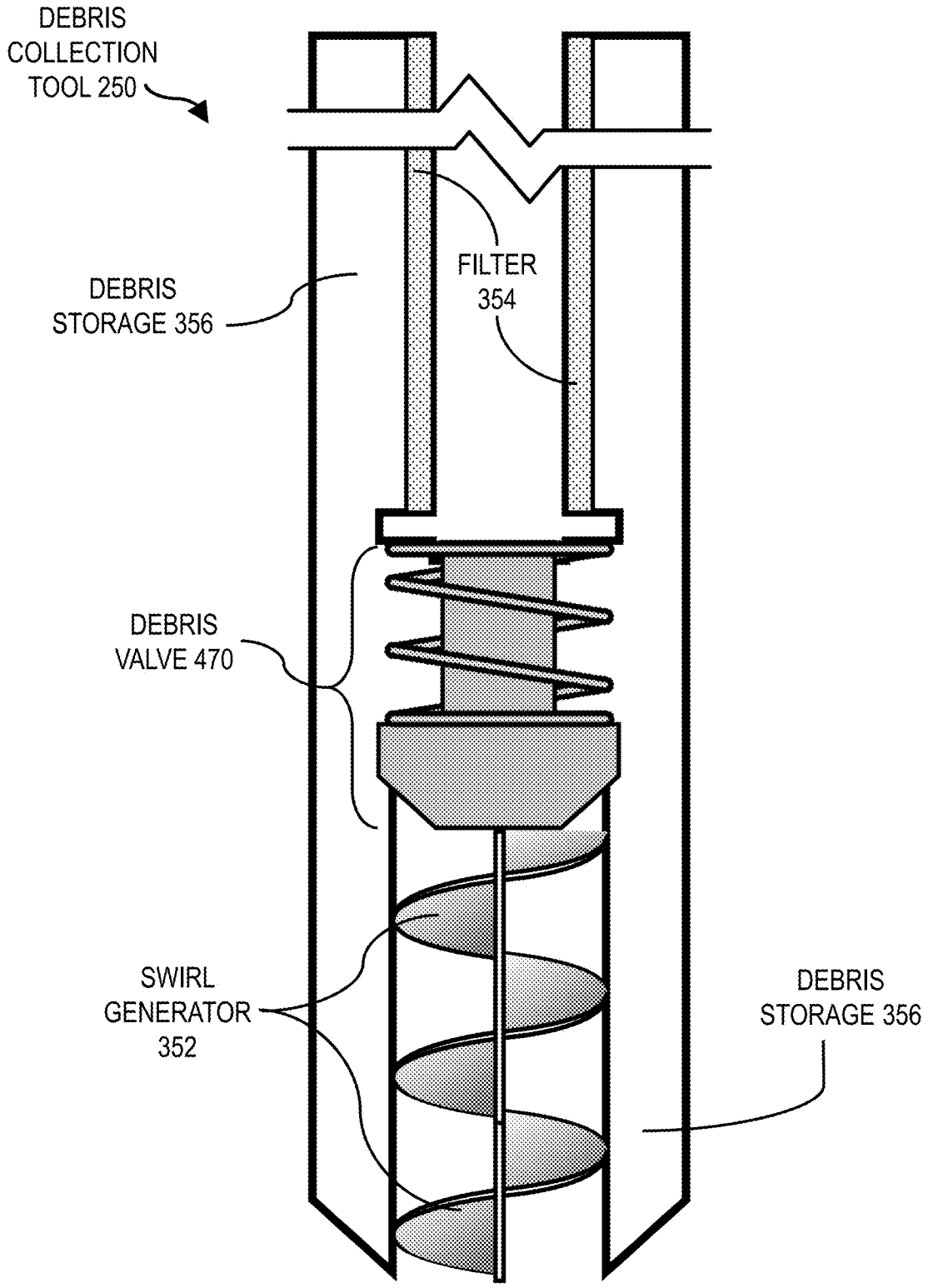
FIG. 5A is a diagram of an example debris collection tool with a debris valve.
Figure 5B:
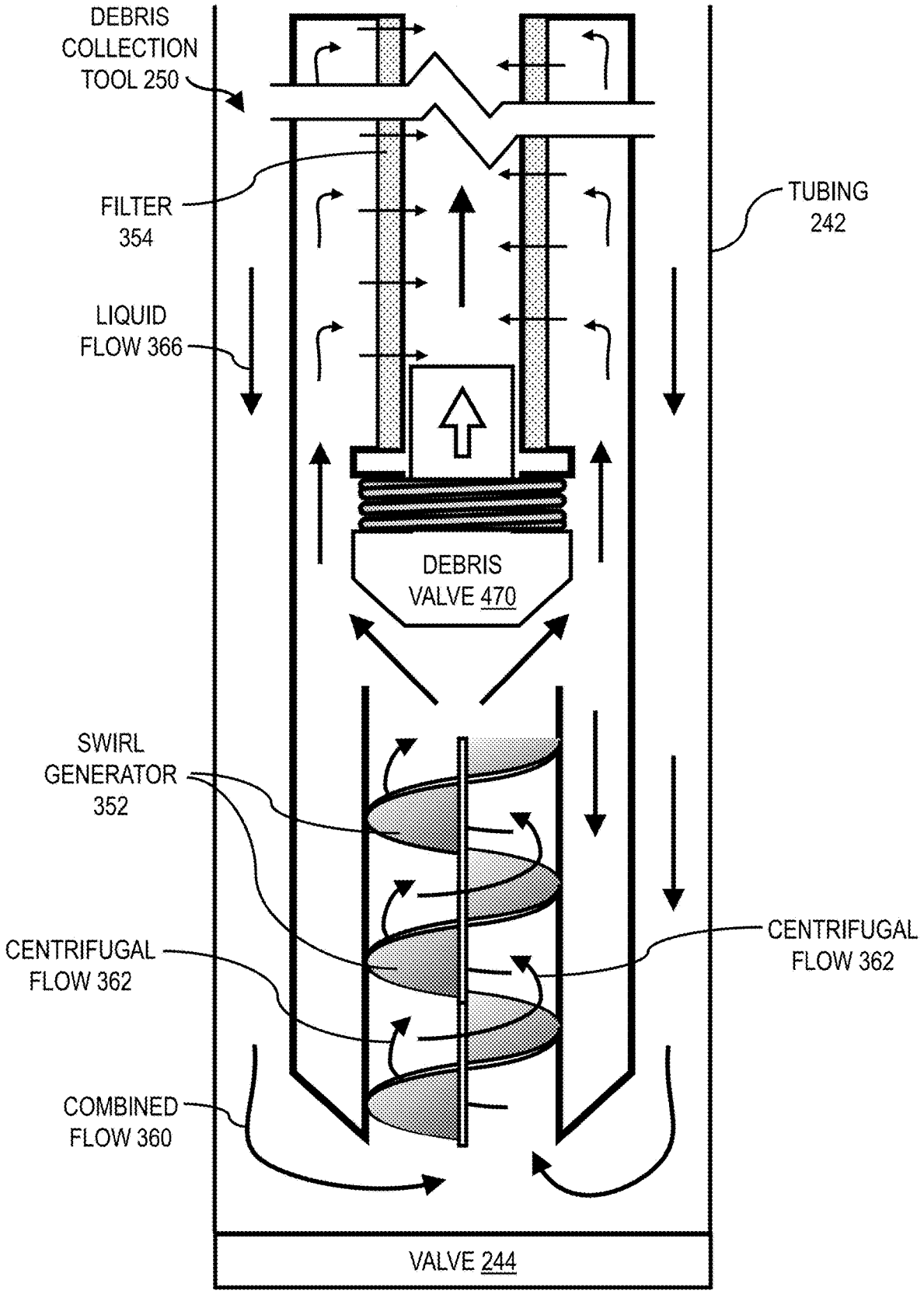
FIG. 5B is a diagram of an example debris collection tool showing flow paths therethrough.
Figure 5C:
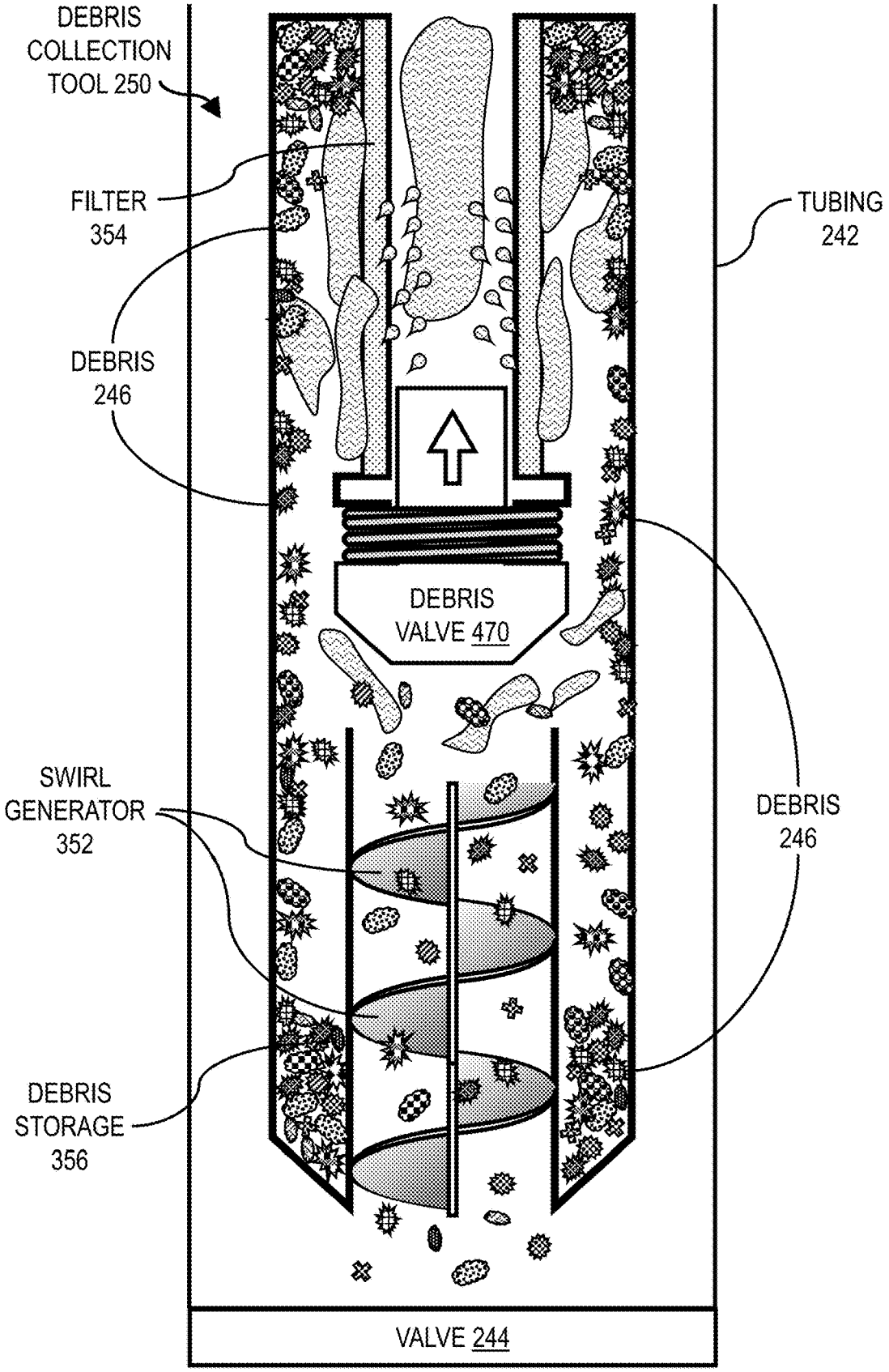
FIG. 5C is a diagram of an example debris collection tool showing liquid and debris separation while in use.
Figure 5D:
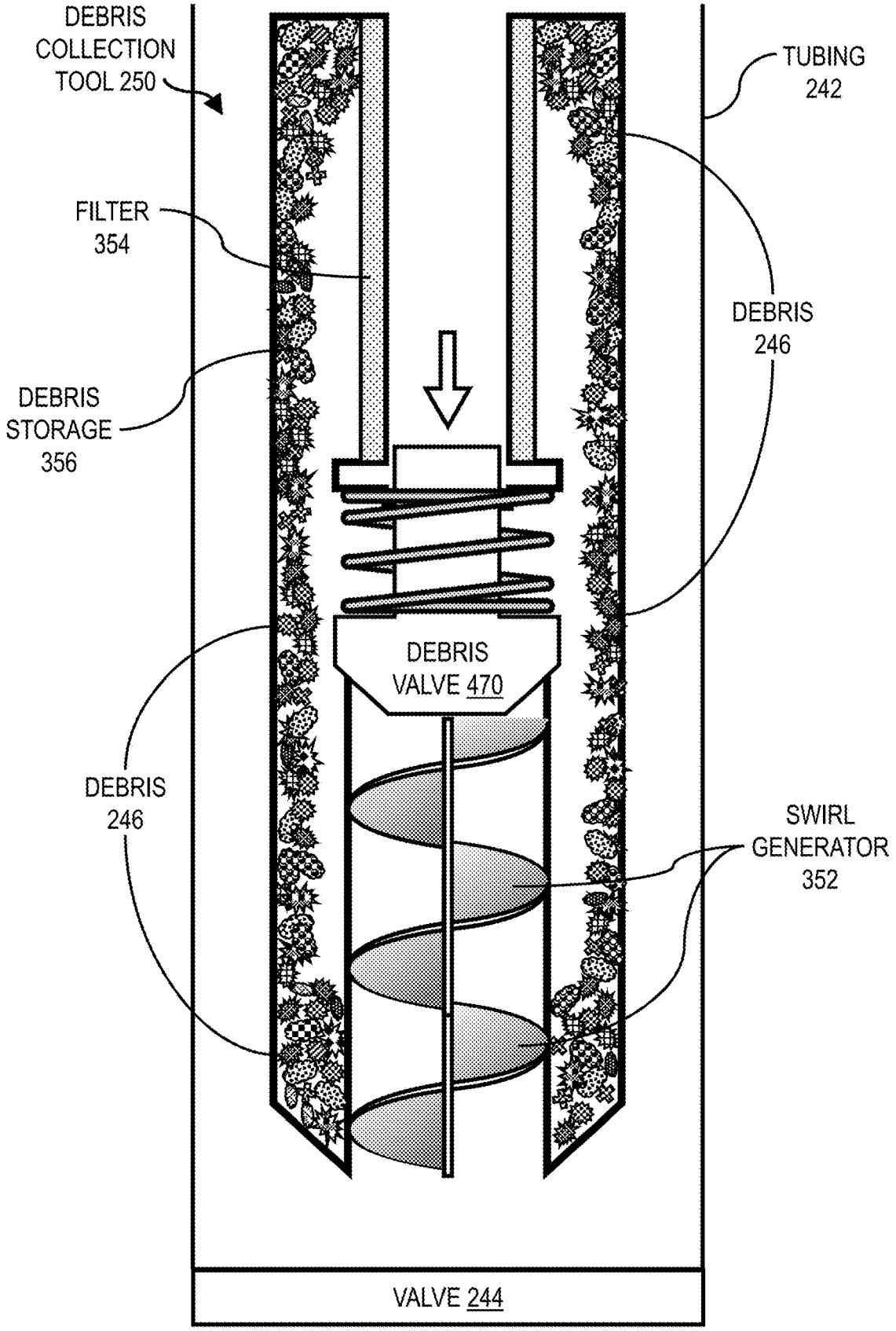
FIG. 5D is a diagram of an example debris collection tool showing accumulated debris after use.

FIG. 5A is a diagram of an example debris collection tool with a debris valve. FIG. 5B is a diagram of an example debris collection tool showing flow paths therethrough. FIG. 5C is a diagram of an example debris collection tool showing liquid and debris separation while in use. FIG. 5D is a diagram of an example debris collection tool showing accumulated debris after use.

In one or more embodiments, debris collection tool 250 of FIGS. 5A-5D may be used in any orientation (e.g., filter 354 does not have to be disposed above swirl generator 352) as tubing 242 changes orientation downhole. Accordingly, debris storage 356 may be disposed along the outer walls of debris collection tool 250 as debris 246 is brought to the walls by centrifugal forces. As a non-limiting example, debris collection tool 250 may be used "vertically" (e.g., where swirl generator 352 is disposed vertically below filter 354), "horizontally (e.g., "sideways", where filter 354 and swirl generator 352 are disposed laterally adjacent), or any angle in between.

Debris valve 470 is a valve which may open and close to prevent debris 246 from exiting debris collection tool 250 (back into tubing 242). Debris valve 470, as shown in FIGS. 5A-5D, is a linear spring activated plunger. However, any suitable type of valve may be used (e.g., a flapper valve, ball valve, butterfly valve, etc.). In one or more embodiments, when flow through debris collection tool 250 is initiated, the forces caused by the flow are sufficient to open debris valve 470 and allow liquid and debris 246 to pass into the internal volume (debris storage 356) of debris collection tool 250. Further, when flow is stopped, debris valve 470 may close (e.g., via any spring or other controlling force) and thereby prevent debris from re-entering swirl generator 352 and exiting debris collection tool 250.

Methods of Use

In one or more embodiments, using debris collection tool 250 may involve one or more step(s) to perform debris collection from tubing, as described below. All or a portion of the method described may be performed by one or more components of drilling environment 100 (see description in FIG. 1), a debris collection tool, and/or a user/operator thereof. While the various steps in this method are presented and described sequentially, a person of ordinary skill in the relevant art (having the benefit of this detailed description) would appreciate that some or all steps may be executed in different orders, combined, or omitted, and some or all steps may be executed in parallel.

A first step may include disposing debris collection tool 250 downhole. In one or more embodiments, disposing debris collection tool 250 downhole may include attaching debris collection tool 250 to a conveyance (e.g., coiled tubing, other tubing, pipe, etc.) and lowering the conveyance and debris collection tool 250 to the desired location in tubing 242. The desired location in tubing 242 may depend upon the location of the accumulation of debris 246 (e.g., atop a downhole component, valve 244, neck, sleeve, plug, etc.).

A second step may include causing a liquid to flow through tubing 242 and debris collection tool 250. In one or more embodiments, liquid from the surface (e.g., drilling fluid 128, production fluid, water, any water-based mixture, etc.) may be pumped down in tubing 242 (around debris collection tool 250 as liquid flow 366), where liquid returns upward through debris collection tool 250 to the surface.

A third step may include causing debris 246 from tubing 242 to be picked up and flow into debris collection tool 250. In one or more embodiments, the liquid pumped down in tubing (as liquid flow 366) may cause debris 246 to be mixed with the liquid (as combined flow 360), which then enters swirl generator 352 of debris collection tool 250 and settles in debris storage 356. That is, causing debris 246 to move from tubing 242 to debris collection tool 250 may include (i) sucking combined flow 360 into a first opening of debris collection tool 250, (ii) causing centrifugal flow of combined flow 360 in swirl generator 352, and (iii) separating centrifugal flow 362 into liquid flow 366 and debris flow 364. Debris flow 364 may then cause debris 246 to settle in debris storage 356.

A fourth step may include removing debris collection tool 250 from tubing 242. In one or more embodiments, after debris collection tool 250 is full (e.g., debris storage 356 is saturated) and/or sufficient debris 246 is removed from the desired location in tubing 242, an operator may pull debris collection tool 250 uphole (e.g., via the conveyance debris collection tool 250 was lowered in with).

A fifth step may include emptying, cleaning, or otherwise disposing of debris 246 from debris collection tool 250. In one or more embodiments, as debris collection tool 250 returns to the surface, debris 246 accumulated in debris collection tool 250 (e.g., in debris storage 356) may be removed from debris collection tool 250. Thus, debris collection tool 250 may be prepared for reuse downhole to remove additional debris 246 from tubing 242. Accordingly, these steps may be repeated until debris 246 is sufficiently removed from tubing 242.

Solutions and Improvements

The methods and systems described above are an improvement over the current technology as the methods and systems described herein provide a debris collection tool which uses a swirl generator to separate fluid and debris. In turn, the centrifugal forces cause the liquid and debris to separate, where debris may be collected in designated volumes within the debris collection tool. As there is efficient separation of debris and liquid, greater volumes of debris may be removed in a single use of the debris collection tool. Further, as filters disposed in the debris collection tool do not clog (or do not clog as quickly), greater volumes of debris may be collected before removal of the debris collection tool required. Accordingly, significant time and money are saved as fewer runs of a debris collection tool are required to remove unwanted debris in the tubing.

In comparison, conventional debris collection tools use direct suction or bailing techniques to remove debris by pumping debris-contaminated liquid through filters to catch the debris. Once debris is collected against filters, flow paths through the filters are obstructed, and the pressures required to continue pumping liquid exceed allowable limits. Accordingly, such conventional devices allow for only a limited volume of debris to be removed in a single instance, as the filters quickly clog and limit the flow of the liquid. After gathering a small volume of debris, the debris collection tool must be pulled back to the surface where the debris can be emptied (e.g., the filters are cleaned). After emptying, the debris collection tool must be re-run downhole to collect additional and remaining debris. As multiple trips in-and-out of the tubing are required to remove all of the debris, significant amounts of time, money, and energy are expended performing this debris removal operation repeatedly.

Statements

The systems and methods may comprise any of the various features disclosed herein, comprising one or more of the following statements.

Statement 1. A debris collection tool, comprising a debris valve; a swirl generator, comprising a first opening disposed on an exterior of the debris collection tool; a second opening disposed inside the debris collection tool wherein the first opening and the second opening are disposed at opposite axial ends of the swirl generator.

Statement 2. The debris collection tool of statement 1, wherein the swirl generator is configured to accept a combined flow of liquid and debris via the first opening.

Statement 3. The debris collection tool of statement 2, wherein the debris valve is configured to open when the combined flow enters the first opening.

Statement 4. The debris collection tool of statement 3, wherein the debris valve is configured to close when flow stops through the debris collection tool.

Statement 5. The debris collection tool of statement 4, wherein the debris exits the swirl generator from the second opening as a debris flow.

Statement 6. The debris collection tool of statement 5, wherein the liquid exits the swirl generator from the second opening as a liquid flow.

Statement 7. The debris collection tool of statement 6, wherein the swirl generator is configured to cause the debris flow to have greater centrifugal momentum than the liquid flow.

Statement 8. The debris collection tool of statement 7, further comprising a filter.

Statement 9. The debris collection tool of statement 8, wherein the filter is configured to allow the liquid flow to pass through the filter.

Statement 10. The debris collection tool of statement 9, wherein the filter is configured to prevent the debris flow from passing through the filter.

Statement 11. The debris collection tool of statements 4-10, further comprising a debris storage.

Statement 12. The debris collection tool of statement 11, wherein the debris collection tool is configured to cause debris to accumulate in the debris storage.

Statement 13. A method for removing debris from tubing, comprising disposing the debris collection tool of statement 1 in the tubing causing a liquid flow through the tubing and the debris collection tool; moving the debris from the tubing to debris storage of the debris collection tool.

Statement 14. The method of statement 13, wherein moving the debris from the tubing comprises sucking a combined flow into the first opening.

Statement 15. The method of statement 14, wherein moving the debris from the tubing further comprises causing a centrifugal flow of the combined flow in the swirl generator.

Statement 16. The method of statement 15, wherein moving the debris from the tubing further comprises separating the centrifugal flow into the liquid flow and a debris flow.

Statement 17. The method of statement 16, wherein the liquid flow and the debris flow exit the swirl generator via the second opening.

Statement 18. The method of statement 17, wherein the swirl generator is configured to cause the debris flow to have greater centrifugal momentum than the liquid flow.

Statement 19. The method of statement 18, wherein the greater centrifugal momentum of the debris flow causes the debris to accumulate in the debris storage.

Statement 20. The method of statement 19, wherein the debris collection tool is disposed horizontally.

General Notes

As it is impracticable to disclose every conceivable embodiment of the technology described herein, the figures, examples, and description provided herein disclose only a limited number of potential embodiments. A person of ordinary skill in the relevant art would appreciate that any number of potential variations or modifications may be made to the explicitly disclosed embodiments, and that such alternative embodiments remain within the scope of the broader technology. Accordingly, the scope should be limited only by the attached claims. Further, the compositions and methods are described in terms of "comprising," "containing," or "including" various components or steps, the compositions and methods may also "consist essentially of" or "consist of" the various components and steps. Moreover, the indefinite articles "a" or "an," as used in the claims, are defined herein to mean one or more than one of the elements that it introduces. Certain technical details, known to those of ordinary skill in the relevant art, may be omitted for brevity and to avoid cluttering the description of the novel aspects.

For further brevity, descriptions of similarly named components may be omitted if a description of that similarly named component exists elsewhere in the application. Accordingly, any component described with respect to a specific figure may be equivalent to one or more similarly named components shown or described in any other figure, and each component incorporates the description of every similarly named component provided in the application (unless explicitly noted otherwise). A description of any component is to be interpreted as an optional embodiment—which may be implemented in addition to, in conjunction with, or in place of an embodiment of a similarly—named component described for any other figure.

Lexicographical Notes

As used herein, adjective ordinal numbers (e.g., first, second, third, etc.) are used to distinguish between elements and do not create any ordering of the elements. As an example, a "first element" is distinct from a "second element", but the "first element" may come after (or before) the "second element" in an ordering of elements. Accordingly, an order of elements exists only if ordered terminology is expressly provided (e.g., "before", "between", "after", etc.) or a type of "order" is expressly provided (e.g., "chronological", "alphabetical", "by size", etc.). Further, use of ordinal numbers does not preclude the existence of other elements. As an example, a "table with a first leg and a second leg" is any table with two or more legs (e.g., two legs, five legs, thirteen legs, etc.). A maximum quantity of elements exists only if express language is used to limit the upper bound (e.g., "two or fewer", "exactly five", "nine to twenty", etc.). Similarly, singular use of an ordinal number does not imply the existence of another element. As an example, a "first threshold" may be the only threshold and therefore does not necessitate the existence of a "second threshold".

As used herein, indefinite articles "a" and "an" mean "one or more". That is, the explicit recitation of "an" element does not preclude the existence of a second element, a third element, etc. Further, definite articles (e.g., "the", "said") mean "any one of" (the "one or more" elements) when referring to previously introduced element(s). As an example, there may exist "a processor", where such a recitation does not preclude the existence of any number of other processors. Further, "the processor receives data, and the processor processes data" means "any one of the one or more processors receives data" and "any one of the one or more processors processes data". It is not required that the same processor both (i) receive data and (ii) process data. Rather, each of the steps ("receive" and "process") may be performed by different processors.

What is claimed is:

1. A debris collection tool, comprising:
a debris valve;
a swirl generator, comprising:
a first opening disposed on a downhole distal end of the debris collection tool; and
a second opening disposed entirely on an interior of the debris collection tool; and
a debris storage surrounding the swirl generator, wherein when the debris valve is in a closed position, the debris storage is isolated from the swirl generator,
wherein the first opening and the second opening are disposed at opposite axial ends of the swirl generator,
wherein, when the debris valve is in the closed position, the debris valve blocks the second opening,
wherein the first opening is disposed upstream of the second opening along a flow path, and
wherein a flow along the flow path causes the debris valve to open.

2. The debris collection tool of claim 1, wherein the swirl generator is configured to accept a combined flow of liquid and debris via the first opening.

3. The debris collection tool of claim 2, wherein the debris valve is configured to open when the combined flow enters the first opening.

4. The debris collection tool of claim 3, wherein the debris valve is configured to close when flow stops through the debris collection tool.

5. The debris collection tool of claim 4, wherein the debris exits the swirl generator from the second opening as a debris flow.

6. The debris collection tool of claim 5, wherein the liquid exits the swirl generator from the second opening as a liquid flow.

7. The debris collection tool of claim 6, wherein the swirl generator is configured to cause the debris flow to have greater centrifugal momentum than the liquid flow.

8. The debris collection tool of claim 7, further comprising:
a filter.

9. The debris collection tool of claim 8, wherein the filter is configured to allow the liquid flow to pass through the filter.

10. The debris collection tool of claim 9, wherein the filter is configured to prevent the debris flow from passing through the filter.

11. A method for removing debris from tubing, comprising:
disposing the debris collection tool of claim 1 in the tubing;
causing a liquid flow through the tubing and the debris collection tool; and
moving the debris from the tubing to the debris storage of the debris collection tool.

12. The method of claim 11, wherein moving the debris from the tubing comprises:
sucking a combined flow into the first opening.

13. The method of claim 12, wherein moving the debris from the tubing further comprises:
causing a centrifugal flow of the combined flow in the swirl generator.

14. The method of claim 13, wherein moving the debris from the tubing further comprises:

separating the centrifugal flow into the liquid flow and a debris flow.

15. The method of claim 14, wherein the liquid flow and the debris flow exit the swirl generator via the second opening.

16. The method of claim 15, wherein the swirl generator is configured to cause the debris flow to have greater centrifugal momentum than the liquid flow.

17. The method of claim 16, wherein the greater centrifugal momentum of the debris flow causes the debris to accumulate in the debris storage.

18. The method of claim 17, wherein the debris collection tool is disposed horizontally.

19. The method of claim 18, wherein the debris collection tool comprises a filter configured to allow the liquid flow to pass through the filter.

20. The method of claim 19, wherein the filter is configured to prevent the debris flow from passing through the filter.

* * * * *